US010249238B2

(12) United States Patent
Ko et al.

(10) Patent No.: US 10,249,238 B2
(45) Date of Patent: Apr. 2, 2019

(54) PIXEL DRIVING CIRCUIT, ARRAY SUBSTRATE, DISPLAY PANEL AND DISPLAY APPARATUS HAVING THE SAME, AND DRIVING METHOD THEREOF

(71) Applicants: BOE TECHNOLOGY GROUP CO., LTD., Beijing (CN); CHENGDU BOE OPTOELECTRONICS TECHNOLOGY CO., LTD., Chengdu (CN)

(72) Inventors: Youngyik Ko, Beijing (CN); Bo Wang, Beijing (CN); Yipeng Chen, Beijing (CN); Yi Zhang, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu (CN)

( * ) Notice: Subject to any disclaimer, the term of this patent is extended or adjusted under 35 U.S.C. 154(b) by 73 days.

(21) Appl. No.: 15/513,279

(22) PCT Filed: Aug. 23, 2016

(86) PCT No.: PCT/CN2016/096369
§ 371 (c)(1),
(2) Date: Mar. 22, 2017

(87) PCT Pub. No.: WO2017/173767
PCT Pub. Date: Oct. 12, 2017

(65) Prior Publication Data

US 2018/0190185 A1 Jul. 5, 2018

(30) Foreign Application Priority Data

Apr. 6, 2016 (CN) ..... 2016 1 0210384

(51) Int. Cl.
*G09G 3/325* (2016.01)
*G09G 3/3233* (2016.01)

(52) U.S. Cl.
CPC ..... *G09G 3/325* (2013.01); *G09G 3/3233* (2013.01); *G09G 2300/0819* (2013.01);
(Continued)

(58) Field of Classification Search
CPC ..... G09G 3/3233; G09G 2300/0819; G09G 2320/045; G09G 2320/043; G09G 2300/043; G09G 3/3258; G09G 2300/0809
See application file for complete search history.

(56) References Cited

U.S. PATENT DOCUMENTS 9,747,839 B2 * 8/2017 Wang ..... G09G 3/3233
2006/0038754 A1 2/2006 Kim
(Continued)

FOREIGN PATENT DOCUMENTS

CN 1728219 A 2/2006
CN 100481183 C 4/2009
(Continued)

OTHER PUBLICATIONS

First Office Action in the Chinese Patent Application No. 201610210384.9, dated Sep. 28, 2017; English translation attached.
(Continued)

*Primary Examiner* — Sanjiv D. Patel
(74) *Attorney, Agent, or Firm* — Intellectual Valley Law, P.C.

(57) ABSTRACT

The present application discloses a pixel driving circuit configured to operate in a display cycle including sequentially an initialization period, a compensation period, and a light-emitting period, the pixel driving circuit including a
(Continued)

driving transistor having a gate, a source, and a drain; a first storage capacitor having a first terminal connected to the gate of the driving transistor and a second terminal connected to a first power signal input port; an emission control sub-circuit disposed between the source of the driving transistor and the first power signal input port; a data write-in sub-circuit disposed between a data input port and the drain of the driving transistor which is also connected to the emission control sub-circuit; a compensation sub-circuit disposed between the source of the driving transistor and the first terminal of the first storage capacitor; and a light emitting device having a first terminal connected to the emission control sub-circuit and a second terminal connected to a second power signal input port; the data write-in sub-circuit is configured to control a data voltage signal to be passed into the drain of the driving transistor during the compensation period; the compensation sub-circuit is configured to control a connection between the source and the gate of the driving transistor during the compensation period to set the driving transistor to a conduction state for inducing a source-to-drain current until a gate voltage of the driving transistor reaches a value substantially equal to the data voltage signal plus a threshold voltage of the driving transistor.

20 Claims, 14 Drawing Sheets

(52) U.S. Cl.
CPC ..... *G09G 2300/0861* (2013.01); *G09G 2300/0876* (2013.01); *G09G 2310/0251* (2013.01); *G09G 2310/0262* (2013.01); *G09G 2320/0233* (2013.01); *G09G 2320/045* (2013.01)

(56) References Cited

U.S. PATENT DOCUMENTS

| | | | | |
|---|---|---|---|---|
| 2006/0125737 | A1 | 6/2006 | Kwak et al. | |
| 2006/0267885 | A1 | 11/2006 | Kwak et al. | |
| 2012/0001893 | A1* | 1/2012 | Jeong | G09G 3/3233 345/213 |
| 2014/0175992 | A1 | 6/2014 | Yang | |
| 2015/0049126 | A1* | 2/2015 | Jung | G09G 3/3233 345/690 |
| 2015/0123557 | A1 | 5/2015 | Lee et al. | |
| 2015/0187270 | A1 | 7/2015 | Lee et al. | |
| 2016/0203794 | A1* | 7/2016 | Lim | G09G 3/3225 345/213 |
| 2017/0018226 | A1 | 1/2017 | Yang et al. | |

FOREIGN PATENT DOCUMENTS

| | | | |
|---|---|---|---|
| CN | 102314829 | A | 1/2012 |
| CN | 103000134 | A | 3/2013 |
| CN | 104282263 | A | 1/2015 |
| CN | 104575377 | A | 4/2015 |
| CN | 104978932 | A | 10/2015 |
| KR | 20150064544 | A | 6/2015 |

OTHER PUBLICATIONS

International Search Report & Written Opinion dated Dec. 30, 2016 regarding PCT/CN2016/096369.

* cited by examiner

PIXEL DRIVING CIRCUIT, ARRAY SUBSTRATE, DISPLAY PANEL AND DISPLAY APPARATUS HAVING THE SAME, AND DRIVING METHOD THEREOF

CROSS-REFERENCE TO RELATED APPLICATION

This application is a national stage application under 35 U.S.C. § 371 of International Application No. PCT/CN2016/096369, filed Aug. 23, 2016, which claims priority to Chinese Patent Application No. 201610210384.9, filed Apr. 6, 2016, the contents of which are incorporated by reference in the entirety.

TECHNICAL FIELD

The present invention relates to display technology, more particularly, to a pixel driving circuit, an array substrate, a display panel and a display apparatus having the same, and a driving method thereof.

BACKGROUND

In an active matrix organic light emitting diode (AMOLED), light emission is driven by a saturation current generated by a driving transistor. Driving transistors with different threshold voltages Vth, even when inputted with a same input grayscale voltage, may produce saturation currents having different values for driving the AMOLED. For example, a low temperature polysilicon (LTPS) driving transistor-based AMOLED display panel typically has poor threshold voltage uniformity throughout the display panel. Moreover, the threshold voltage Vth typically drifts over time in such a display panel. All these issues contribute to non-uniformity in display brightness throughout the display panel.

As shown in FIG. 1, a conventional pixel driving circuit includes a first transistor T1, a second transistor T2, a third transistor T3, a fourth transistor T4, a fifth transistor T5, a sixth transistor T6, a seventh transistor T7, a first capacitor C1, and an OLED. EM is an input port for emitting light control signal. G is an input port for data write-in control signal. Vdata is a data voltage signal. Vinit is an initialization voltage signal. Re is an input port for the initialization control signal. T3 is the driving transistor. A source of T3 is received a high voltage level VDD and a drain of T3 is connected to an anode of OLED via the sixth transistor T6. A cathode of the OLED is received a low voltage level VSS. Referring to FIG. 1, the first capacitor C1 is connected between a gate of T3 and a second terminal of T7. A first terminal of T5 and a first terminal of T7 are commonly connected to a reference voltage input port configured to receive a reference voltage Vref. When the pixel driving circuit is operated by coupling to a high voltage level VDD, a parasitic capacitance between the gate and source of T3 may affect the gate voltage level of the driving transistor. As a result, the gate voltage level of the driving transistor cannot be maintained at a stable value.

SUMMARY

In one aspect, the present invention provides a pixel driving circuit configured to operate in a display cycle including sequentially an initialization period, a compensation period, and a light-emitting period, the pixel driving circuit comprising a driving transistor having a gate, a source, and a drain; a first storage capacitor having a first terminal connected to the gate of the driving transistor and a second terminal connected to a first power signal input port; an emission control sub-circuit disposed between the source of the driving transistor and the first power signal input port; a data write-in sub-circuit disposed between a data input port and the drain of the driving transistor which is also connected to the emission control sub-circuit; a compensation sub-circuit disposed between the source of the driving transistor and the first terminal of the first storage capacitor; and a light emitting device having a first terminal connected to the emission control sub-circuit and a second terminal connected to a second power signal input port.

Optionally, the data write-in sub-circuit is configured to control a data voltage signal to be passed into the drain of the driving transistor during the compensation period; the compensation sub-circuit is configured to control a connection between the source and the gate of the driving transistor during the compensation period to set the driving transistor to a conduction state for inducing a source-to-drain current until a gate voltage of the driving transistor reaches a value substantially equal to the data voltage signal plus a threshold voltage of the driving transistor.

Optionally, the pixel driving circuit further comprises a first initialization sub-circuit connected to the light emitting device and configured to control a connection between the first terminal of the light emitting device and a first input port of an initialization voltage signal.

Optionally, the pixel driving circuit further comprises a second initialization sub-circuit connected to the gate of the driving transistor and configured to control a connection between the gate of the driving transistor and the first input port of the initialization voltage signal.

Optionally, the emission control sub-circuit is configured to control, during the light-emitting period, a first connection between the source of the driving transistor and the first power signal input port and a second connection between the drain of the driving transistor and the first terminal of the light emitting device.

Optionally, the data write-in sub-circuit comprises a data-write-in transistor having a gate connected to a second input port of a compensation control signal, a first terminal connected to the drain of the driving transistor, and a second terminal connected to the data input port.

Optionally, the compensation sub-circuit comprises a compensation transistor having a gate connected to the second input port of the compensation control signal, a first terminal connected to the source of the driving transistor, and a second terminal connected to the gate of the driving transistor.

Optionally, the first initialization sub-circuit comprises a first initialization transistor having a gate connected to a third input port of an initialization control signal, a first terminal connected to the first input port of the initialization voltage signal, and a second terminal connected to the first terminal of the light emitting device; the second initialization sub-circuit comprises a second initialization transistor having a gate connected to the third input port of the initialization control signal, a first terminal connected to the gate of the driving transistor, and a second terminal connected to the first input port of the initialization voltage signal.

Optionally, the emission control sub-circuit comprises a first emission-control transistor and a second emission-control transistor, the first emission-control transistor having a gate connected to an fourth input port of an emission control signal, a first terminal connected to the first power signal input port, and a second terminal connected to the source of the driving transistor; the second emission-control transistor having a gate connected to the fourth input port of the emission control signal, a first terminal connected to the drain of the driving transistor, and a second terminal connected to the first terminal of the light emitting device.

Optionally, the pixel driving circuit further comprises a second storage capacitor having a first terminal connected to the gate of the driving transistor and a second terminal connected to the first input port of the initialization voltage signal.

Optionally, the light emitting device comprises an organic light emitting diode with the first terminal being an anode and the second terminal being a cathode.

In another aspect, the present invention provides a method of driving a pixel driving circuit, comprising controlling passage of the data voltage signal from the data input port to the drain of the driving transistor using the data write-in sub-circuit during the compensation period of a display cycle; and controlling a connection between the source of the driving transistor and the gate of the driving transistor using the compensation sub-circuit during the compensation period, to set the driving transistor to a conduction state for inducing a source-to-drain current until a gate voltage of the driving transistor reaches a value substantially equal to the data voltage signal plus a threshold voltage of the driving transistor.

Optionally, the pixel driving circuit comprises a first initialization sub-circuit connected to the first terminal of the light emitting device, the method comprises controlling the first terminal of the light emitting device to receive an initialization voltage from a first input port using the first initialization sub-circuit during the initialization period of the display cycle, the initialization period being prior to the compensation period.

Optionally, the pixel driving circuit comprises a second initialization sub-circuit connected to the gate of the driving transistor, the method comprises controlling the gate of the driving transistor to be initialized at the initialization voltage from the first input port using the second initialization sub-circuit during the initialization period.

Optionally, the method comprises controlling a connection between the source of the driving transistor and the first power signal input port and a connection between the drain of the driving transistor and the first terminal of the light emitting device using the emission control sub-circuit during the light-emitting period, to set the driving transistor in a conduction state with a current for driving light emitting device to emit light, the light emitting period being next to the compensation period.

Optionally, the data write-in sub-circuit comprises a data-write-in transistor having a gate connected to a second input port of a compensation control signal, a first terminal connected to the drain of the driving transistor, and a second terminal connected to the data input port, the method further comprising setting the data-write-in transistor in a conduction state using the compensation control signal from the second input port, to connect the drain of the driving transistor to the data input port so as to control passing the data voltage signal from the data input port to the drain of the driving transistor.

Optionally, the compensation sub-circuit comprises a compensation transistor having a gate connected to the second input port of the compensation control signal, a first terminal connected to the source of the driving transistor, and a second terminal connected to the gate of the driving transistor, the method further comprising setting the compensation transistor to a conduction state using the compensation control signal, to connect the source of the driving transistor to the gate of the driving transistor.

Optionally, the first initialization sub-circuit comprises a first initialization transistor having a gate connected to a third input port of an initialization control signal, a first terminal connected to the first input port for the initialization voltage signal, and a second terminal connected to the first terminal of the light emitting device, the method further comprises setting the first initialization transistor to a conduction state using the initialization control signal, to connect the first input port to the first terminal of the light emitting device to pass the initialization voltage signal from the first input port to the first terminal of the light emitting device.

Optionally, the second initialization sub-circuit comprises a second initialization transistor having a gate connected to the third input port of the initialization control signal, a first terminal connected to the gate of the driving transistor, and a second terminal connected to the first input port of the initialization voltage signal, the method further comprises setting the second initialization transistor to a conduction state using the initialization control signal, to connect the first input port to the gate of the driving transistor to pass the initialization voltage signal from the first input port to the gate of the driving transistor.

In another aspect, the present invention provides an array substrate comprising a plurality of pixel driving circuits described herein formed on a substrate.

Optionally, the array substrate further comprises a plurality of first power signal input lines disposed in a thin film on the substrate, wherein each of the plurality of first power signal input lines is connected to the first power signal input port per pixel driving circuit; wherein the plurality of first power signal input lines is arranged in a mesh pattern spatially.

Optionally, the array substrate further comprises a plurality of scan lines, a plurality of data lines, a plurality of initialization voltage lines, a plurality of initialization control signal lines, and a plurality of emission control lines respectively disposed in one or more thin films on the substrate; wherein each of the plurality of scan lines is connected to the second input port of the compensation control signal per pixel driving circuit; each of the plurality of data lines is connected to the data input port per pixel driving circuit; each of the plurality of initialization voltage lines is connected to the first input port of the initialization voltage signal per pixel driving circuit; each of the plurality of initialization control signal lines is connected to the third input port of the initialization control signal per pixel driving circuit; and each of the plurality of emission control lines is connected to the fourth input port of the emission control signal per pixel driving circuit.

In another aspect, the present invention provides a display panel comprising an array substrate described herein.

In another aspect, the present invention provides a display apparatus comprising a display panel described herein.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now describe more specifically with reference to the following embodiments. It is to be noted that the following descriptions of some embodiments are presented herein for purpose of illustration and description only. It is not intended to be exhaustive or to be limited to the precise form disclosed.

The present disclosure provides a pixel driving circuit, an array substrate, a display panel and a display apparatus having the same, and a driving method thereof that substantially obviate one or more of the problems due to limitations and disadvantages of the related art. In one aspect, the present disclosure provides a novel pixel driving circuit configured to operate in a display cycle including sequentially an initialization period, a compensation period, and a light-emitting period. In some embodiments, the pixel driving circuit includes a driving transistor having a gate, a source, and a drain; a first storage capacitor having a first terminal connected to the gate of the driving transistor and a second terminal connected to a first power signal input port; an emission control sub-circuit disposed between the source of the driving transistor and the first power signal input port; a data write-in sub-circuit disposed between a data input port and the drain of the driving transistor which is also connected to the emission control sub-circuit; a compensation sub-circuit disposed between the source of the driving transistor and the first terminal of the first storage capacitor; and a light emitting device having a first terminal connected to the emission control sub-circuit and a second terminal connected to a second power signal input port. The data write-in sub-circuit is configured to control a data voltage signal to be passed into the drain of the driving transistor during the compensation period. The compensation sub-circuit is configured to control a connection between the source and the gate of the driving transistor during the compensation period to set the driving transistor to a conduction state for inducing a source-to-drain current until a gate voltage of the driving transistor reaches a value substantially equal to the data voltage signal plus a threshold voltage of the driving transistor.

Figure 1:
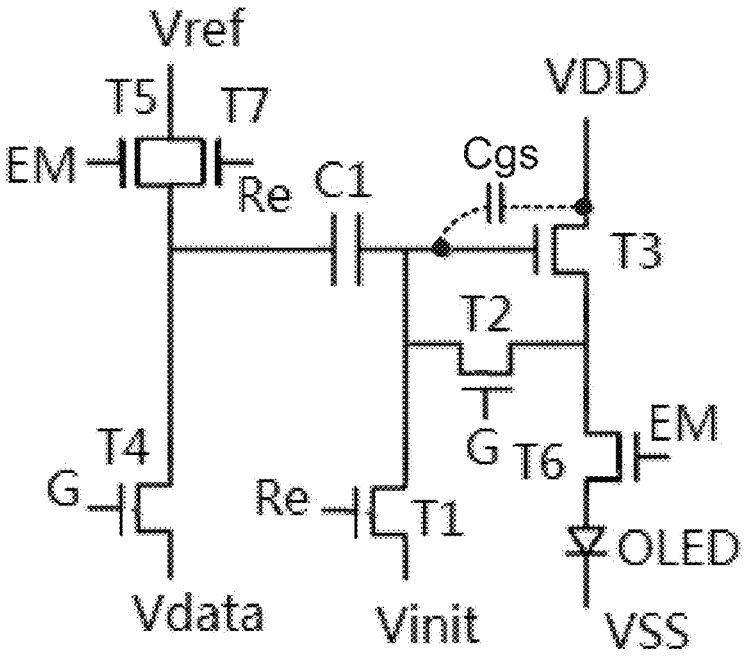
FIG. 1 Related Art
FIG. 1 is a circuit diagram of a conventional pixel driving circuit.
Figure 2:
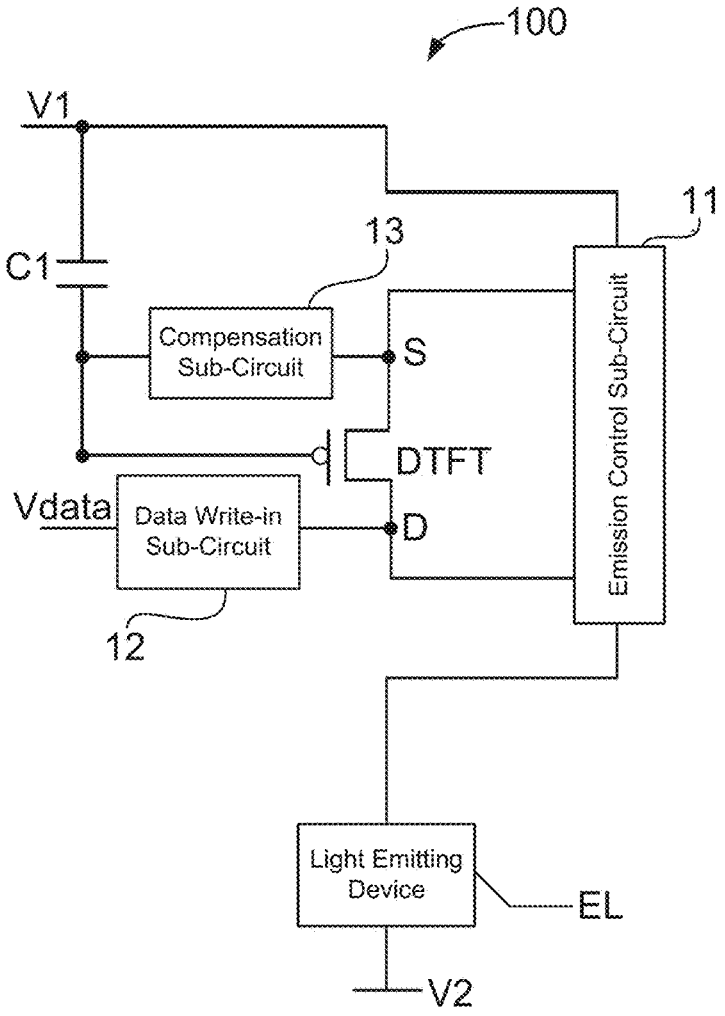
FIG. 2 is a block diagram of a pixel driving circuit according to some embodiments of the present disclosure.

FIG. 2 is a block diagram of a pixel driving circuit according to some embodiments of the present disclosure. Referring to FIG. 2, a pixel driving circuit 100 is illustrated in a simplified block diagram according to an embodiment, including a light emitting device EL, a driving transistor DTFT, a first capacitor C1, an emission control sub-circuit 11, a data write-in sub-circuit 12, and a compensation sub-circuit 13. The pixel driving circuit 100 is operated to drive the light emitting device to emit light according to a data voltage signal designated for a pixel in a display cycle (e.g., each pixel in each display cycle). In some embodiments, the display cycle at least includes sequentially an initialization period, a compensation period, and a light-emitting period.

Referring to FIG. 2, the first capacitor C1 has a first terminal connected to a gate of the driving transistor DTFT and a second terminal connected to a first power signal input port V1. The driving transistor DTFT has a first terminal S connected to the first power signal input port V1 via the emission control sub-circuit 11 and also connected to the first terminal of the first capacitor C1 via the compensation sub-circuit 13. The driving transistor DTFT has a second terminal D connected to a first terminal of the light emitting device EL and also connected to a data input port via the data write-in sub-circuit 12.

Referring to FIG. 2, a data voltage Vdata is provided to the data input port. A second terminal of the light emitting device EL is connected to a second power signal input port V2. The data write-in sub-circuit 12 in the pixel driving circuit 100 is configured to control writing the data voltage Vdata into the second terminal D of the driving transistor DTFT during the compensation period within a display cycle for operating the pixel driving circuit. Additionally, the compensation sub-circuit 13 in the pixel driving circuit 100 is configured during the compensation period to control connecting the first terminal S of the driving transistor DTFT to the gate of the driving transistor. The gate voltage of the driving transistor DTFT is able to control it in either a conduction state or blocking state depending on the voltage value corresponding to n or p transistor type. The compensation sub-circuit 13 controls the driving transistor DTFT to conduction state so as to induce a current flowing from the source to the drain of the driving transistor DTFT. Since the gate is connected to the source, the gate voltage changes as the current increases until it reaches a value substantially equal to a drain voltage at the second terminal D plus a threshold voltage, i.e., Vdata+Vth, where Vth is referred to the threshold voltage of the driving transistor DTFT.

Referring to FIG. 2, the pixel driving circuit 100 includes the first capacitor C1 between the gate of the driving transistor DTFT and the first power signal input port V1. In the embodiment, the capacitance of C1 is substantially larger than parasitic capacitance Cgs between gate and source of the driving transistor DTFT. The gate voltage level can be substantially maintained by the first capacitor C1. This design solves an issue that the gate voltage of the driving transistor cannot be maintained a stable level due to existence of the parasitic capacitance Cgs when the source of the driving transistor is coupled with a power signal from the first power signal input port.

Referring to FIG. 2 again, the pixel driving circuit 100 uses the data write-in sub-circuit 12 to control the data voltage Vdata to be written into the second terminal D of the driving transistor DTFT. The pixel driving circuit 100 further uses the compensation sub-circuit 13 to control a connection between the first terminal S of the driving transistor DTFT and the gate of the driving transistor DTFT. Thus, the combination of the data write-in sub-circuit 12 and the compensation sub-circuit 13 is able to control, in the compensation period, the driving transistor at a conduction state to induce a current flowing from the first terminal S to the second terminal D of the driving transistor DTFT. The current increases until the gate voltage level reaches to Vdata+Vth, which is a potential level of the gate of driving transistor just capable of compensating the threshold voltage Vth of the driving transistor during the light-emitting period. Thus, no matter how the values of the threshold voltage Vth vary from one driving transistor in one pixel to another driving transistor in another pixel or drift over time or upon any environmental change, the intensity of emitted light (driven by the pixel driving circuit) will not be affected so that the issues of display brightness non-uniformity or brightness decay over time are eliminated.

Referring to FIG. 2 again, in the embodiment, the DTFT type is a p-type transistor. The first power signal input port V1 may be provided with a high voltage level (designed to turn off a p-type transistor). The second power signal input port V2 may be correspondingly provided with a low voltage level (designed to turn on a p-type transistor). In a specific implementation of the invention, DTFT can also be an n-type transistor. V1 and V2 can also be set to different voltage levels based on the requirement of the DTFT type or other setting in the pixel driving circuit.

In some embodiments, forming the first capacitor C1 in the pixel driving circuit 100 needs a relative large device area as the capacitance of C1 is set to be much larger than the parasitic capacitance Cgs. This makes a smaller resistance along each terminal of the capacitor, which facilitates maintaining the gate voltage of DTFT (which connects to the second terminal of C1) stable when it is coupled to the high voltage level at the source.

In some embodiments, the pixel driving circuit 100 eliminates a reference voltage input port used in the conventional pixel driving circuit. In the conventional circuit design, the reference voltage lines are needed to be disposed on all pixel circuits in the effective display area. As a result, the reference voltage lines in all pixel units must be disposed either horizontally or vertically in an array substrate, which takes a lot of space and makes less space for arranging the pixel. An array substrate that utilizes the pixel driving circuit 100 according to some embodiments of the present disclosure does not need to dispose such reference voltage lines so that it helps to increase display resolution by integrating more pixels into relative smaller unit area of the array substrate.

Figure 3A:
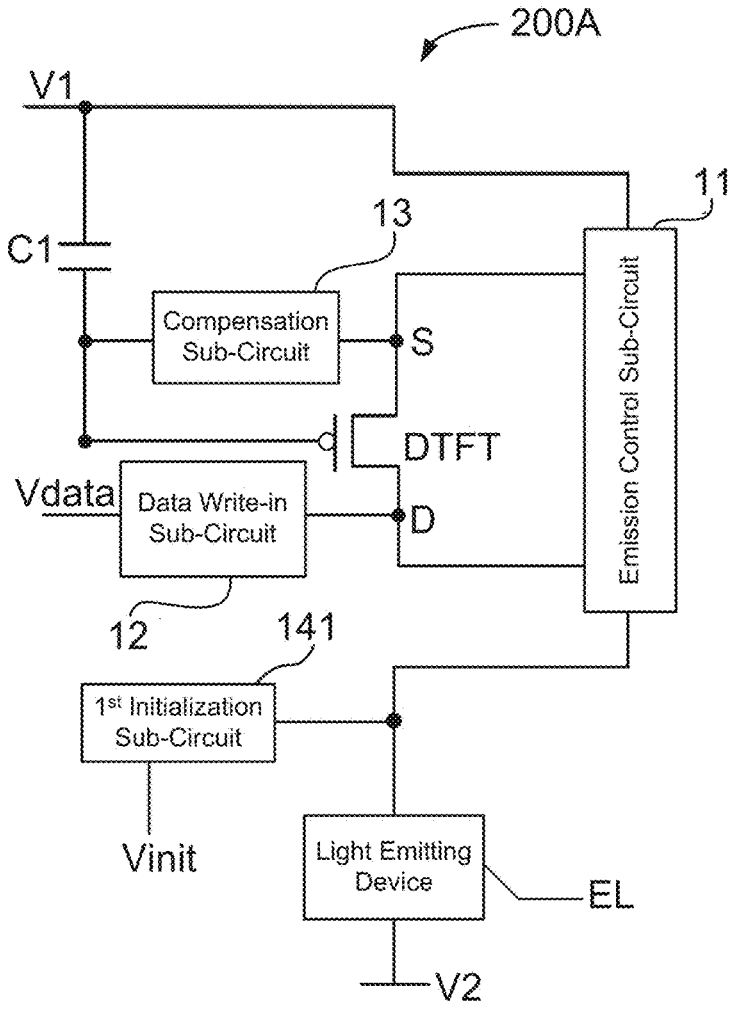
FIG. 3A is a block diagram of a pixel driving circuit according to some embodiments of the present disclosure.

FIG. 3A is a block diagram of a pixel driving circuit according to an embodiment of the present disclosure. Referring to FIG. 3A, a pixel driving circuit 200A is provided as an example of the pixel driving circuit 100 and further includes a first initialization sub-circuit 141. The first initialization sub-circuit 141 is coupled to the first terminal of the light emitting device EL. The first initialization sub-circuit 141 is configured to operate in an initialization period of a display cycle to control a connection between the first terminal of the light emitting device EL and a first input port configured to provide an initialization voltage signal Vinit.

In an embodiment, the first initialization sub-circuit 141 in the pixel driving circuit 200A is operated for initializing a potential level at the first terminal of the light emitting device during the initialization period of a display cycle.

Figure 3B:
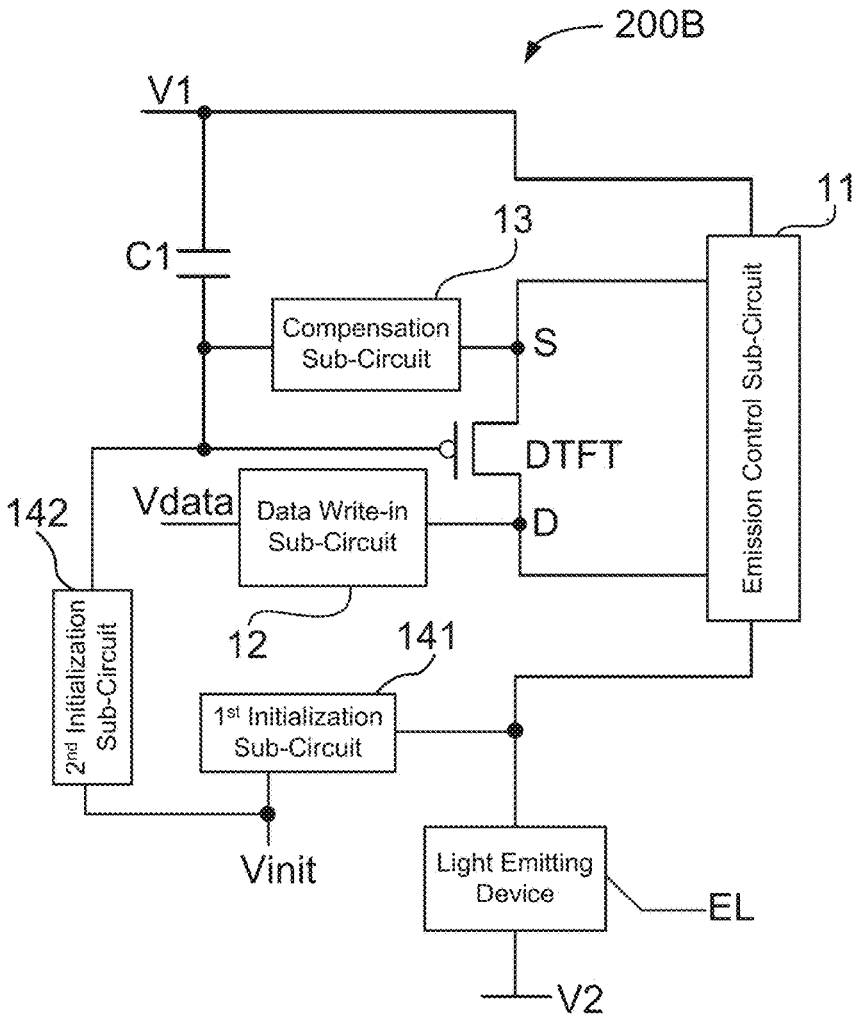
FIG. 3B is a block diagram of a pixel driving circuit according to some embodiments of the present disclosure.

FIG. 3B is a block diagram of a pixel driving circuit according to another embodiment of the present disclosure. Referring to FIG. 3B, a pixel driving circuit 200B is provided as an example of the pixel driving circuit 100. The pixel driving circuit 200B further includes a first initialization sub-circuit 141 and a second initialization sub-circuit 142. The first initialization sub-circuit 141 is disposed the same way described above. The second initialization sub-circuit 142 is coupled to the gate of the driving transistor DTFT and is configured to operate in the initialization period of a display cycle to control a connection between the gate of the driving transistor DTFT and the first input port provided with the initialization voltage signal Vinit.

In an embodiment, the first initialization sub-circuit 141 in the pixel driving circuit 200B is operated for initializing a potential level at the first terminal of the light emitting device during the initialization period of a display cycle. The second initialization sub-circuit 142 in the pixel driving circuit 200B is operated for initializing a potential level at the gate of the driving transistor during the initialization period of a display cycle.

Figure 4:
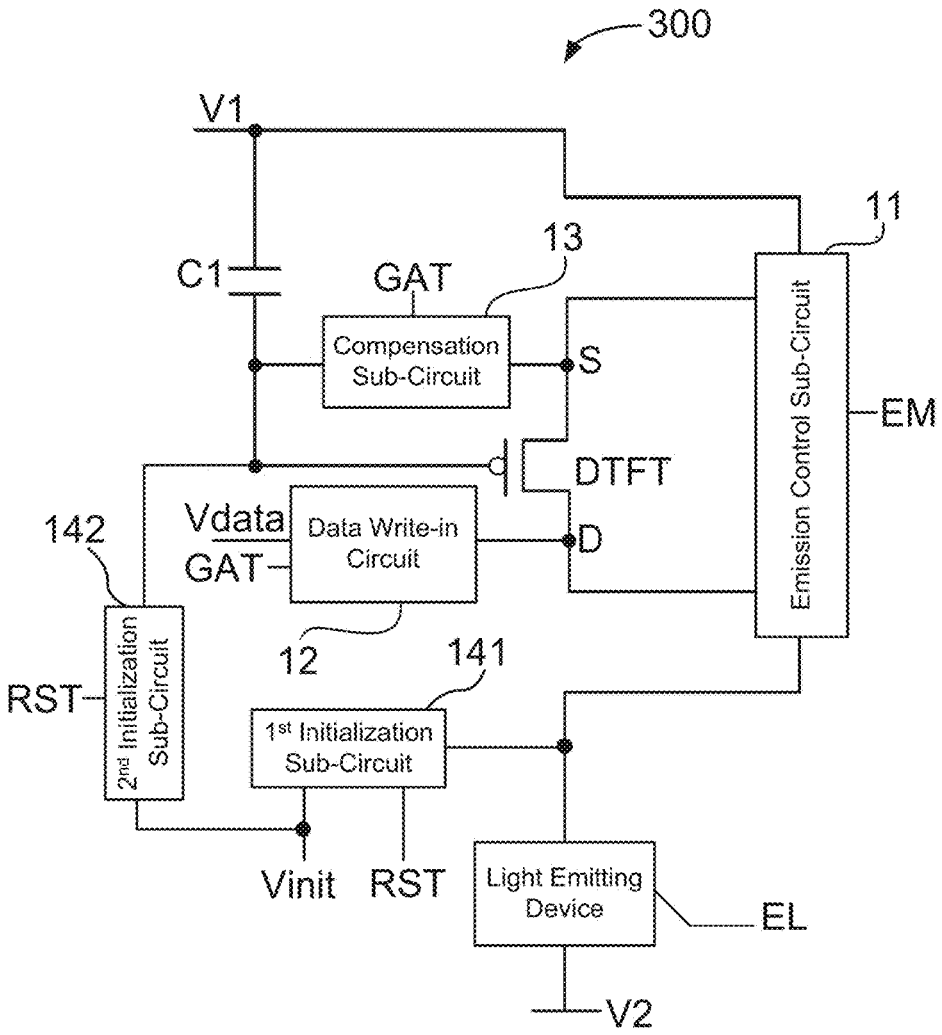
FIG. 4 is a block diagram of a pixel driving circuit according to some embodiments of the present disclosure.

FIG. 4 is a block diagram of a pixel driving circuit according to yet another embodiment of the present disclosure. Referring to FIG. 4, a pixel driving circuit 300 is provided as another example of the pixel driving circuit 100. In the pixel driving circuit 300, the emission control sub-circuit 11 is coupled to a second input port provided with an emission control signal EM. The emission control sub-circuit 11 is configured to operate in a light-emitting period to control a first connection between the first terminal S of the driving transistor DTFT and the first power signal input port V1 and a second connection between the second terminal D of the driving transistor DTFT and the first terminal of the light emitting device EL. As a result, the emission control sub-circuit 11 is able to control the conduction state of the driving transistor so as to drive the light emitting device for emitting light.

Referring to FIG. 4, both the data write-in sub-circuit 12 and the compensation sub-circuit 13 are connected to a third input port provided with a compensation control signal GAT. In the compensation period of a display cycle, the data write-in sub-circuit 12 uses the compensation control signal GAT to control the second terminal D of the driving transistor DTFT being written a data voltage Vdata. Additionally, the compensation sub-circuit 13 is able to control the connection between the first terminal S of the driving transistor DTFT and the gate of the driving transistor DTFT.

Referring to FIG. 4 again, the first initialization sub-circuit 141 and the second initialization sub-circuit 142 are all connected to a fourth input port provided with an initialization control signal RST. In the initialization period of a display cycle, the first initialization sub-circuit 141 uses the initialization control signal RST to control an application of the initialization voltage signal Vinit from the first input port to the first terminal of the light emitting device EL. Additionally, the second initialization sub-circuit 142 uses the initialization control signal RST to control an application of the initialization voltage signal Vinit from the first input port to the gate of the driving transistor DTFT.

Figure 5:
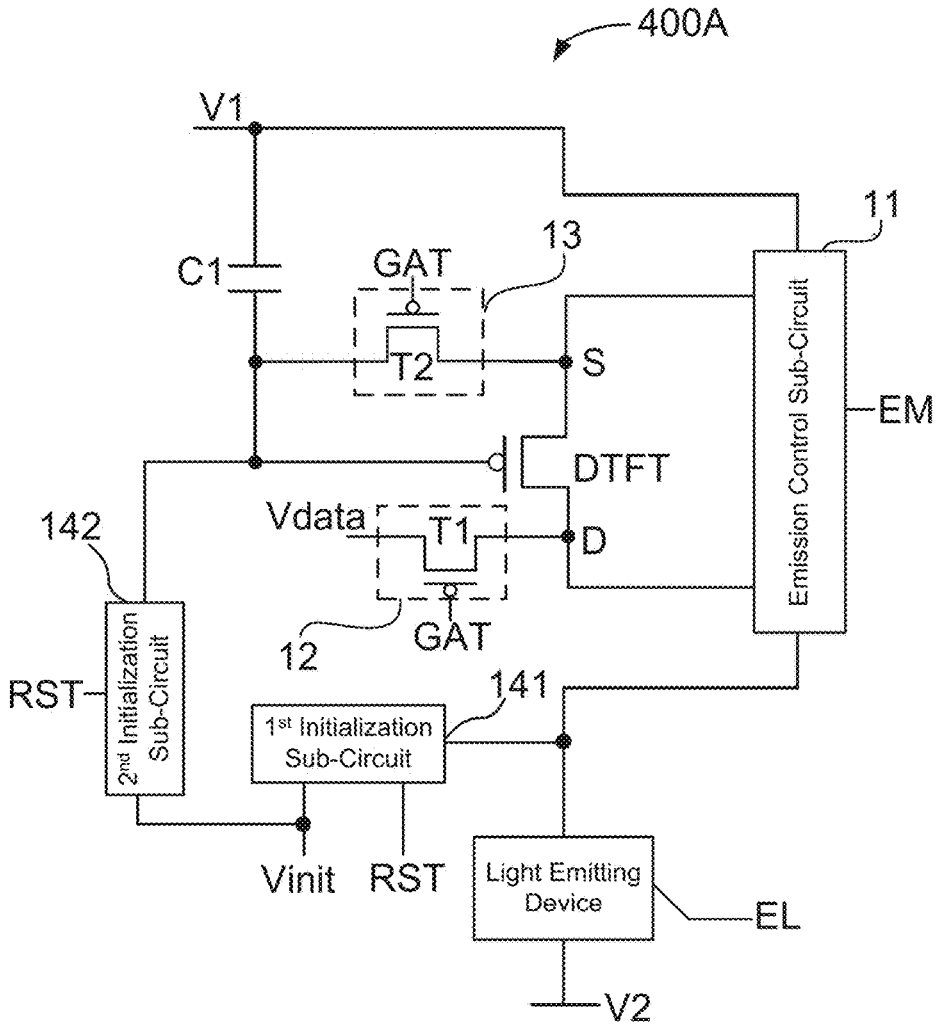
FIG. 5 is a block diagram of a pixel driving circuit according to some embodiments of the present disclosure.

FIG. 5 is a block diagram of a pixel driving circuit according to still another embodiment of the present disclosure. Referring to FIG. 5, a pixel driving circuit 400A is provided as an example of the pixel driving circuit 300. The data write-in sub-circuit 12 in the pixel driving circuit 400A includes a data-write-in transistor T1. T1 has a gate connected to the third input port provided with the compensation control signal GAT. T1 has a first terminal connected to the second terminal D of the driving transistor DTFT and a second terminal connected to the data input port (provided with the data voltage Vdata). The compensation sub-circuit 13 in the pixel driving circuit 400A includes a compensation transistor T2. T2 has a gate connected to the third input port provided with GAT signal. T2 also has a first terminal connected to the first terminal S of the driving transistor DTFT and a second terminal connected to the gate of the driving transistor DTFT.

In the present disclosure, all transistors in the pixel driving circuit including the driving transistor DTFT can be made by thin-film transistors or field-effect transistors or other devices having similar electronic properties. For differentiating two terminals other than a gate of each transistor, one is called a first terminal and another is called a second terminal. The first terminal can be either a source or a drain of the transistor. Correspondingly, the second terminal can be the drain or the source of the transistor. The transistor also is differentiated as either n-type or p-type transistor. In the present disclosure, p-type transistors are selected for all transistors in the pixel driving circuit as an example for illustrating the invention. Alternatively, n-type transistors can be used in the pixel driving circuit.

Referring to FIG. 5, T1 and T2 are all p-type transistors. In the compensation period, the compensation control signal GAT at a low voltage level is able to turn both T1 and T2 on. In an alternative embodiment, T1 and T2 can be all n-type transistors.

Figure 6:
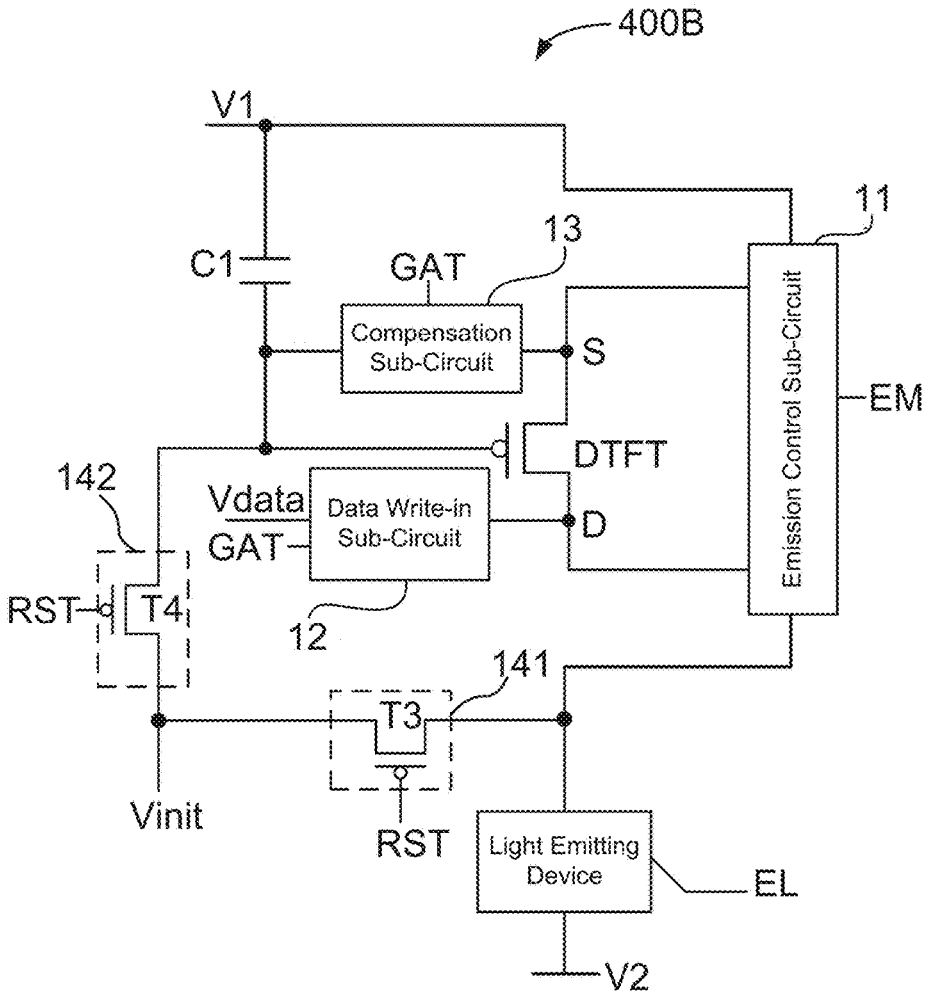
FIG. 6 is a block diagram of a pixel driving circuit according to some embodiments of the present disclosure.

FIG. 6 is a block diagram of a pixel driving circuit according to another embodiment of the present disclosure. Referring to FIG. 6, a pixel driving circuit 400B is provided as an example of the pixel driving circuit 300. The first initialization sub-circuit 141 includes a first initialization transistor T3. T3 has a gate connected to the fourth input port provided with the initialization control signal RST. T3 also has a first terminal connected to the first input port provided with the initialization voltage signal Vinit and a second terminal connected to the first terminal of the light emitting device EL. The second initialization sub-circuit 142 includes a second initialization transistor T4. T4 has a gate also connected to the fourth input port to receive the initialization control signal RST. T4 also has a first terminal connected to the gate of the driving transistor DTFT and a second terminal connected to the first input port to receive the initialization voltage signal Vinit.

Referring to FIG. 6, T3 and T4 are p-type transistors. In the initialization period of a display cycle, the initialization control signal RST is set to a low voltage level to make both T3 and T4 in a conduction state. In an alternative embodiment. T3 and T4 can also be n-type transistors and can be set to a conduction state by a high voltage level.

Figure 7:
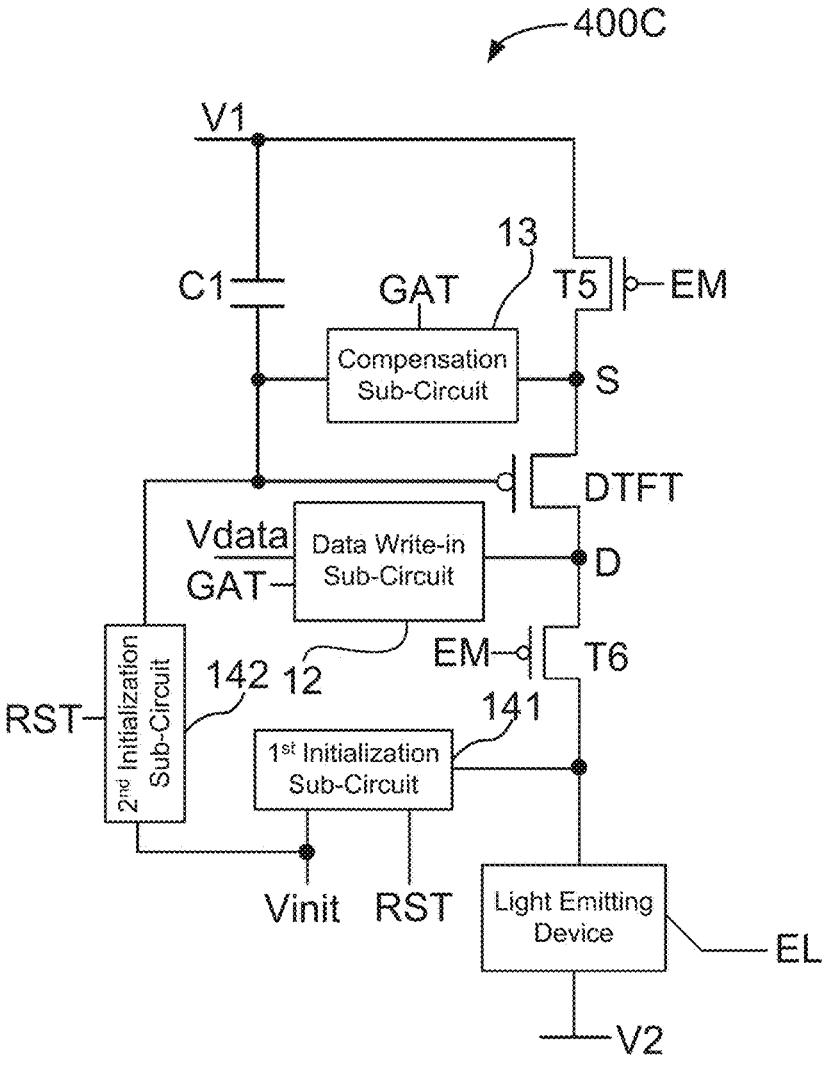
FIG. 7 is a block diagram of a pixel driving circuit according to some embodiments of the present disclosure.

FIG. 7 is a block diagram of a pixel driving circuit according to yet another embodiment of the present disclosure. Referring to FIG. 7, a pixel driving circuit 400C is provided as an example of the pixel driving circuit 300. The emission control sub-circuit in the pixel driving circuit 400C includes a first emission-control transistor T5 and a second emission-control transistor T6. T5 has a gate connected to the second input port provided with the emission control signal EM. T5 also has a first terminal connected to the first power signal input port V1 and a second terminal connected to the first terminal S of the driving transistor DTFT. T6 has a gate connected also to the second input port provided with the emission control signal EM. T6 also has a first terminal connected to the second terminal D of the driving transistor DTFT and a second terminal connected to the first terminal of the light emitting device EL.

Referring to FIG. 7. T5 and T6 are p-type transistors. In the initialization period of a display cycle, the emission control signal EM is set to a low voltage level to make both T5 and T6 in a conduction state. In an alternative embodiment, T5 and T6 can also be n-type transistors and can be set to a conduction state by a high voltage level.

Figure 8:
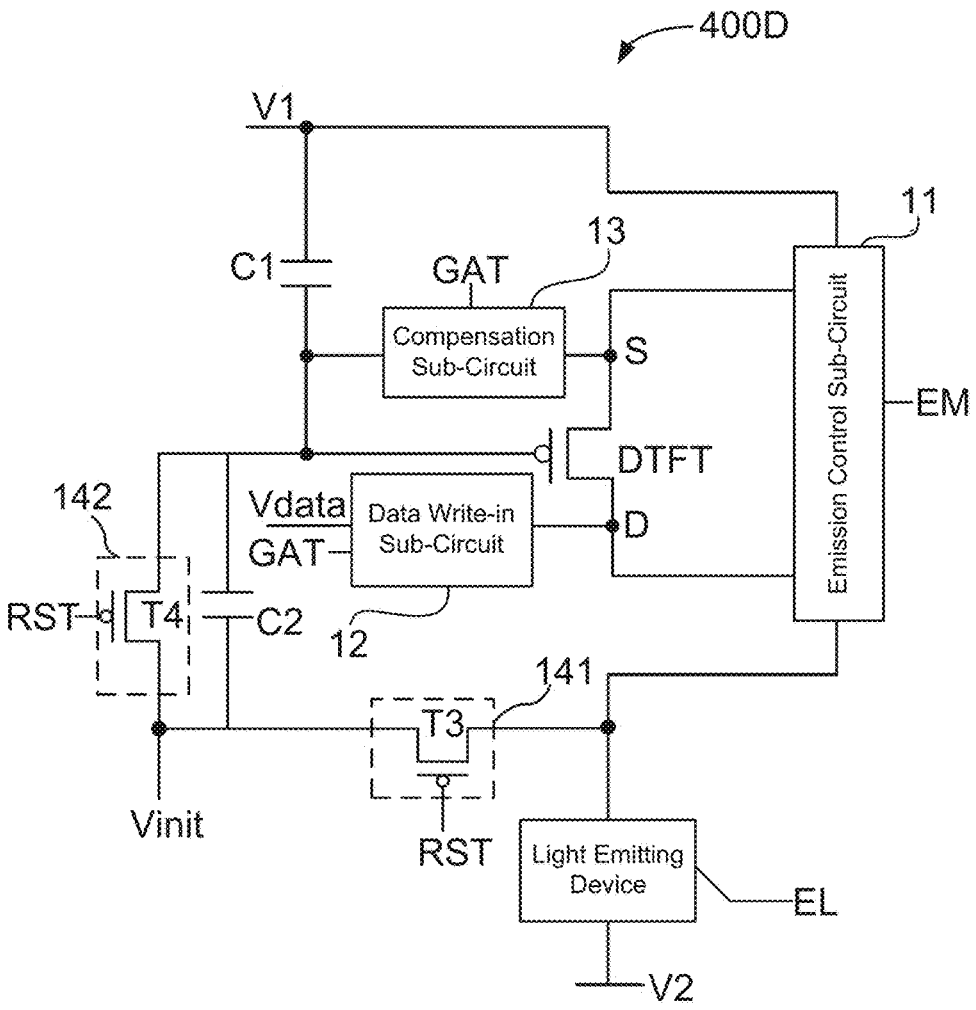
FIG. 8 is a block diagram of a pixel driving circuit according to some embodiments of the present disclosure.

FIG. 8 is a block diagram of a pixel driving circuit according to still another embodiment of the present disclosure. Referring to FIG. 8, a pixel driving circuit 400D is based on the pixel driving circuit 400B as an example of the pixel driving circuit 300. The pixel driving circuit 400D further includes a second capacitor C2 connected between the gate of the driving transistor DTFT and the first input port provided with the initialization voltage signal Vinit. This addition (of C2) allows that the plurality of initialization voltage lines respectively connected to the first input port of all pixel driving circuits can be disposed on an array substrate in a horizontal/vertical net pattern for driving respective pixel light emissions with stable gate voltages.

Figure 9:
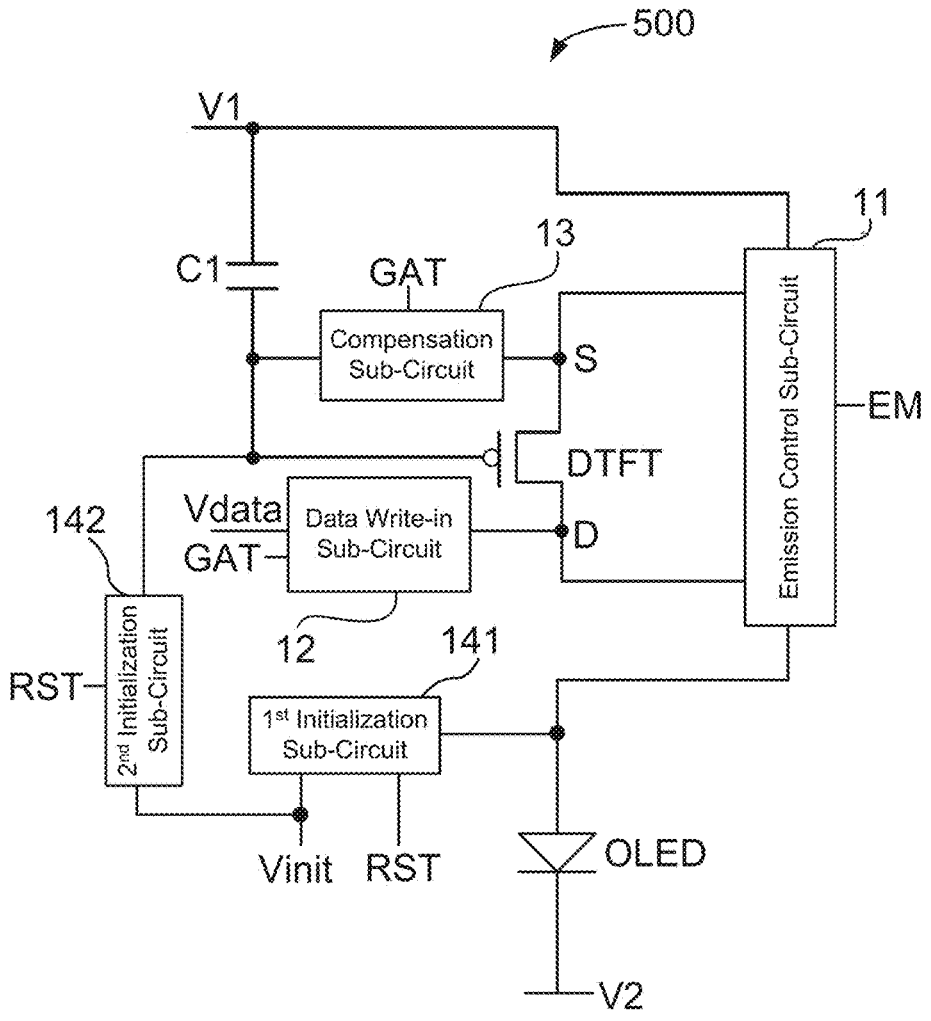
FIG. 9 is a block diagram of a pixel driving circuit according to some embodiments of the present disclosure.

FIG. 9 is a block diagram of a pixel driving circuit according to yet still another embodiment of the present disclosure. Referring to FIG. 9, a pixel driving circuit 500 is provided as an example of the pixel driving circuit 300. The light emitting device EL in the pixel driving circuit 500 is an OLED (organic light emitting diode). The first terminal of EL is an anode of the OLED. Correspondingly, the second terminal of EL is a cathode of the OLED.

Figure 10:
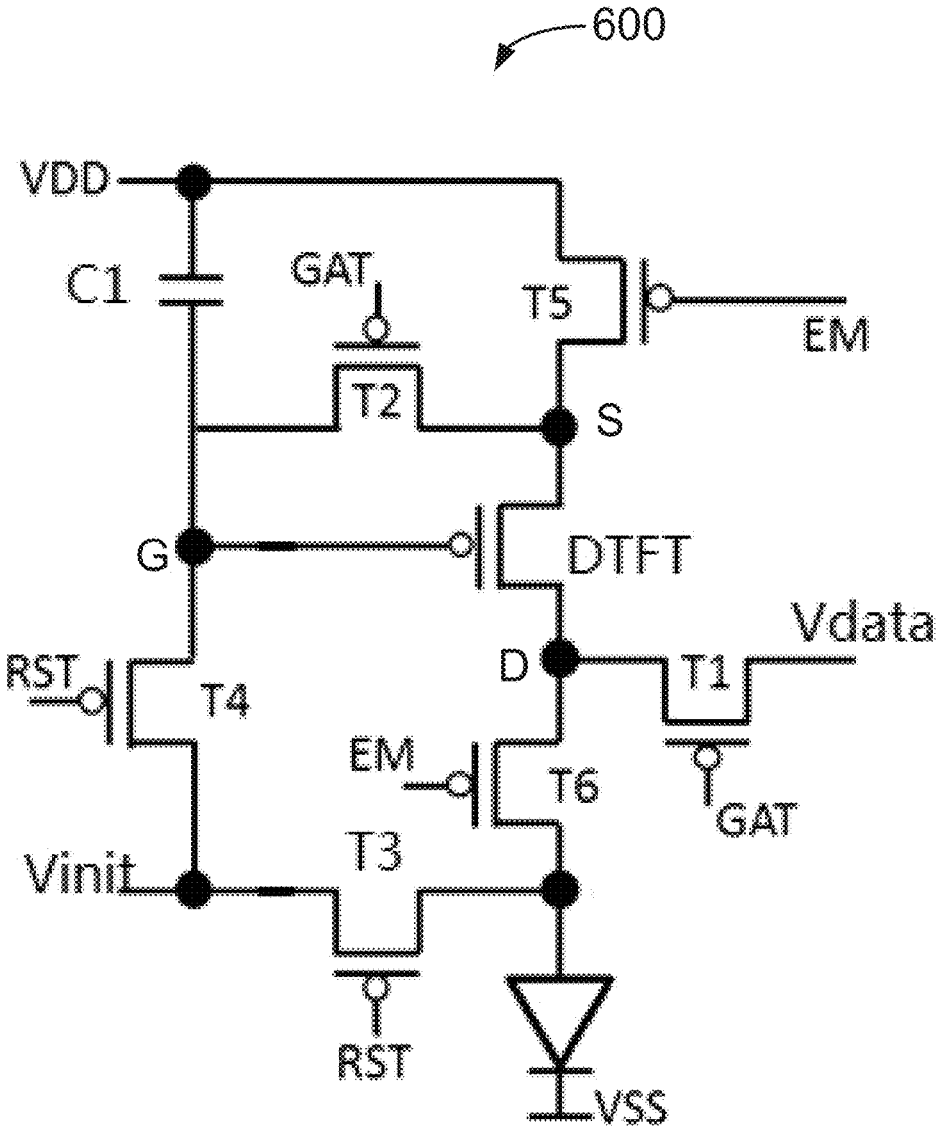
FIG. 10 is a circuit diagram of a pixel driving circuit according to some embodiments of the present disclosure.

FIG. 10 is a circuit diagram of a pixel driving circuit according to some embodiments of the present disclosure. Referring to FIG. 10, pixel driving circuit 600 is provided as an example of the pixel driving circuit 100, 200A, 200B, 300, 400A, 400B, 400C, 400D, and 500. The pixel driving circuit 600 includes an OLED as light emitting device, a driving transistor DTFT, a first storage capacitor C1, a first emission control transistor T5, a second emission control transistor T6, a first initialization transistor T3, a second initialization transistor T4, a data-write-in transistor T1, and a compensation transistor T2. All transistors are p-type transistors.

Referring to FIG. 10, a first terminal of the first capacitor C1 is connected to a gate G of the driving transistor DTFT and a second terminal of C1 is connected to a port outputted with a high voltage level VDD. The data-write-in transistor T1 has a gate connected to an input port provided with a compensation control signal GAT. T1 also has a first terminal connected to a second terminal D of the driving transistor DTFT and a second terminal connected to a data input port with data voltage Vdata.

Referring to FIG. 10 again, the compensation transistor T2 has a gate connected to the input port provided with the compensation control signal GAT. T2 also has a first terminal connected to a first terminal S of the driving transistor DTFT and a second terminal connected to the gate G of the driving transistor DTFT.

Referring to FIG. 10 again, the first initialization transistor T3 has a gate connected to an input port provided with an initialization control signal RST. T3 also has a first terminal connected to another input port provided with an initialization voltage signal Vinit and a second terminal connected to the anode of the OLED.

Referring to FIG. 10 again, the second initialization transistor T4 has a gate connected to the same input port provided with the initialization control signal RST. T4 also has a first terminal connected to the gate G of the driving transistor DTFT and a second terminal connected to another input port provided with the initialization voltage signal Vinit.

Additionally, the first emission-control transistor T5 has a gate connected to an input port provided with an emission control signal EM. T5 also has a first terminal connected to the port outputted with a high voltage level VDD and a second terminal connected to the first terminal S of the driving transistor DTFT. The second emission control transistor T6 has a gate also connected to the same input port provided with the emission control signal EM. T6 also has a first terminal connected to the second terminal D of the driving transistor DTFT and a second terminal connected to the anode of the OLED. The cathode of the OLED is connected to a port outputted with a low voltage level VSS.

Figure 11:
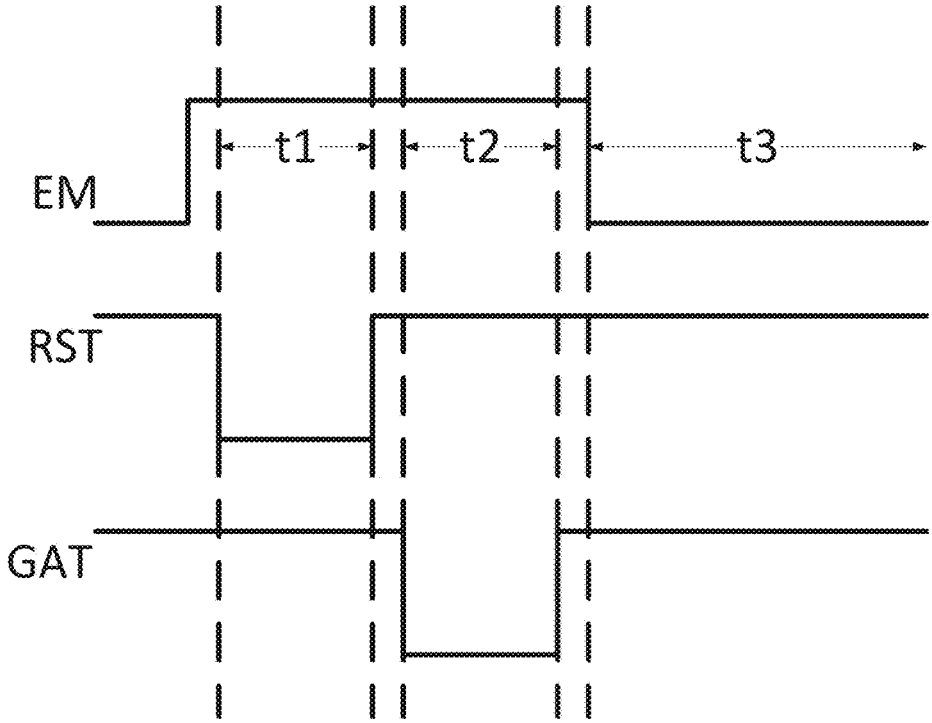
FIG. 11 is an operation timing diagram for operating the pixel driving circuit according to some embodiments of the present disclosure.
Figure 12A:
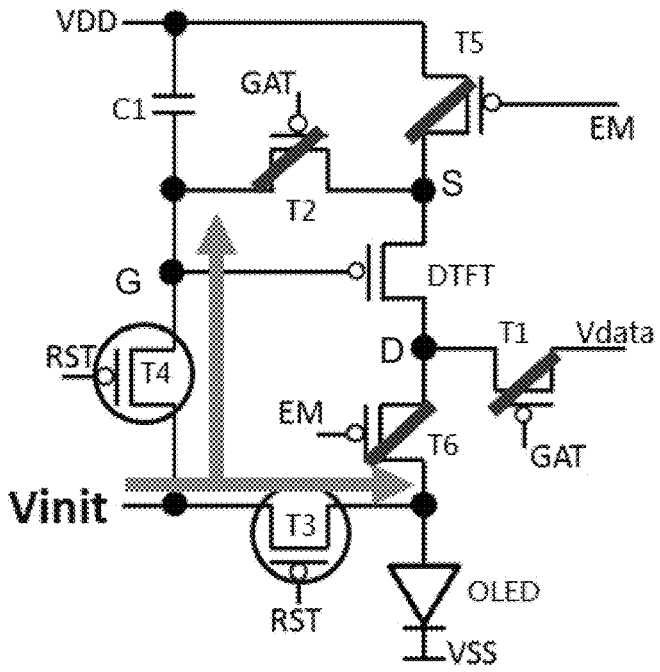
FIG. 12A is a circuit diagram of the pixel driving circuit operated in an initialization period according to some embodiments of the present disclosure.

FIG. 11 is an operation timing diagram for operating the pixel driving circuit according to some embodiments of the present disclosure. As shown, a single display cycle of operating the pixel driving circuit 600 of FIG. 10 includes three consecutive time periods: an initialization period t1, a compensation period t2, and a light-emitting period t3. In the initialization period t1 of the display cycle, initialization control signal RST is set to a low voltage level to turn transistors T3 and T4 on. Emission control signal EM and compensation control signal GAT are set to high voltage level to turn transistor T5, T6, T1, and T2 off. As depicted in FIG. 12A, since T3 and T4 are in conduction states, initialization voltage signal Vinit is written into the gate G of the driving transistor DTFT as well as the anode of the OLED.

Figure 12B:
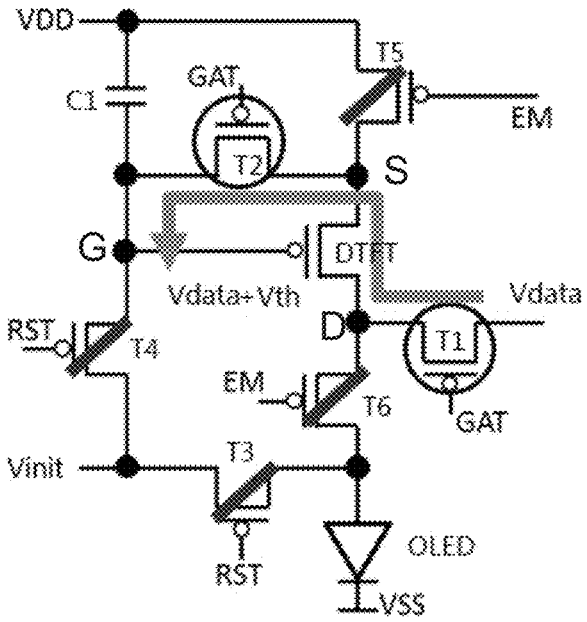
FIG. 12B is a circuit diagram of the pixel driving circuit operated in a compensation period according to some embodiments of the present disclosure.

In the compensation period t2, referring to FIG. 11, RST and EM are set to high voltage level to turn off T5 and T6, while GAT is set to low voltage level so that T1 and T2 are in conduction states. As depicted in FIG. 12B, T1 in conduction state allow Vdata to be written into the second terminal D of the driving transistor DTFT. Since the gate G of the driving transistor DTFT has been written as the initialization voltage level Vinit, DTFT now is in conduction state so that a current flows from the first terminal S to the second terminal D. In this embodiment, the first terminal S is a source of DTFT and the second terminal D is a drain of DTFT. The current increases until the potential level at the gate G reaches to Vdata+Vth to make the gate-to-source voltage Vgs of the DTFT substantially equal to Vth, where Vth is a threshold voltage associated with the driving transistor DTFT.

Figure 12C:
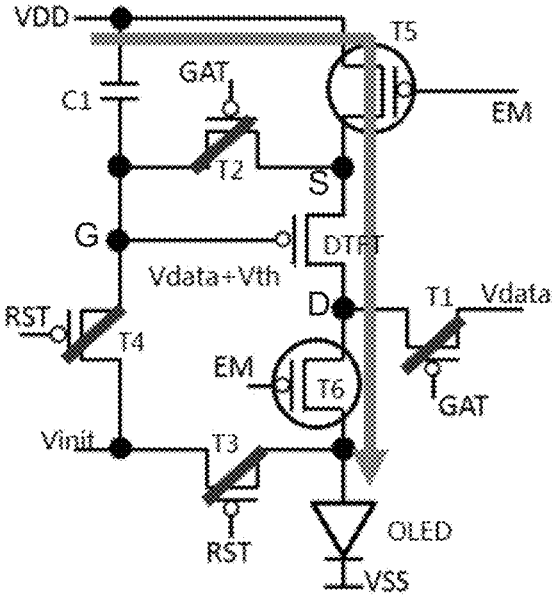
FIG. 12C is a circuit diagram of the pixel driving circuit operated in a light-emitting period according to some embodiments of the present disclosure.

In the light-emitting period t3, referring again to FIG. 11, RST and GAT signals are set to high voltage level while EM is set to low voltage level to turn T5 and T6 on. VDD is passed to the first terminal S of DTFT. As depicted in FIG. 12C, since the gate voltage is set to Vdata+Vth and the DTFT is above the threshold of the conduction state as a current flows from the source to the drain of DTFT, the gate-to-source voltage Vgs in this period becomes Vdata+Vth−VDD. Thus, the threshold voltage Vth of the DTFT can be compensated to eliminate its effect to cause non-uniformity or intensity-decay issues when driving the light emission of OLED.

In FIGS. 12A, 12B, and 12C, the circle is used to mark the transistor that is in conduction state. Slash line crossing the transistor means that it is blocked or in non-conduction state.

In another aspect, the present disclosure provides a method of driving a pixel driving circuit (e.g., a pixel driving circuit of any of FIGS. 2-10). In some embodiments, the method includes at least a compensation process which is executed within a compensation period of a display cycle of operating the pixel driving circuit. In some embodiments, the method includes using the data write-in sub-circuit of the pixel driving circuit to control passage of a data voltage Vdata into the second terminal of the driving transistor. Optionally, the data write-in sub-circuit includes a data-write-in transistor having a gate connected to an input port provided with a compensation control signal, a first terminal connected to the second terminal of the driving transistor, and a second terminal connected to the data input port with the data voltage Vdata. Thus the method includes using the compensation control signal to set the data-write-in transistor to a conduction state so that the second terminal of the driving transistor is connected to the data input port to allow the data voltage Vdata be written into the second terminal of the driving transistor.

The method further includes using the compensation sub-circuit within the compensation period to control a connection between the first terminal of the driving transistor and the gate of the driving transistor and set the driving transistor to a conduction state so that a current flows from the first terminal to a second terminal until the gate voltage reaches a value of Vdata+Vth where Vth is the threshold voltage of the driving transistor. Optionally, the compensation sub-circuit includes a compensation transistor having a gate connected to the same input port provided with the compensation control signal, a first terminal connected to the first terminal of the driving transistor, and a second terminal connected to the gate of the driving transistor. Thus the method includes using the compensation control signal to set the compensation transistor to a conduction state so that the first terminal of the driving transistor is connected to the gate of the driving transistor in the compensation period.

In some embodiments, the method includes using the compensation sub-circuit in the compensation period of a display cycle to control the driving transistor at a conduction state and control the current flowing from the first terminal to the second terminal of the driving transistor until the gate voltage reaches to Vdata+Vth. Then in the light-emitting period next to the compensation period, such gate voltage of the driving transistor is able to compensate the threshold voltage Vth, so that the non-uniformity or intensity-decay issue of the display panel.

In some embodiments, the method includes connecting a first initialization sub-circuit to the first terminal of the light emitting device. Then, in an initialization period prior to the compensation period, the method further includes using the first initialization sub-circuit to control inputting or applying an initialization voltage level from an input port to the first terminal of the light emitting device. In some embodiments, the first initialization sub-circuit includes a first initialization transistor having a gate connected to an input port provided with an initialization control signal, a first terminal connected to the input port provided with the initialization voltage level, and a second terminal connected to the first terminal of the light emitting device. Thus, the method includes using the initialization control signal to set the first initialization transistor to a conduction state so that the first terminal of the light emitting device is connected to the input port provided with the initialization voltage level to allow the first terminal of the light emitting device be initialized to the initialization voltage level.

In some embodiments, the method includes connecting a second initialization sub-circuit to the gate of the driving transistor. Then, in the initialization period, the method further includes using the second initialization sub-circuit to control applying the initialization voltage signal to the gate of the driving transistor. In other words, the method of driving the pixel driving circuit includes initializing a potential level at the gate of the driving transistor as well the first terminal of the light emitting device. In some embodiments, the second initialization sub-circuit includes a second initialization transistor having a gate connected to the input port provided with the initialization control signal, a first terminal connected to the gate of the driving transistor, and a second terminal connected to the input port provided with the initialization voltage level. Thus, the method includes using the initialization control signal to set the second initialization transistor to a conduction state so that the gate of the driving transistor is connected to the input port provided with the initialization voltage level to allow the gate be initialized with the initialization voltage level.

In some embodiments, the method includes, in the light-emitting period, using the emission control sub-circuit to control a first connection between the first terminal of the driving transistor to a first power signal input port and a second connection between the second terminal of the driving transistor and the first terminal of the light emitting device so that the driving transistor can be set to a conduction state to use a current to drive the light emitting device for emitting light.

In some embodiments, the present disclosure provides an array substrate that includes a substrate (for example a glass substrate) with array of pixels in one or more thin films formed thereon and a plurality of pixel driving circuits for respectively driving the array of pixels. In some embodiments, each of the plurality of pixel driving circuits is the pixel driving circuit disclosed in this disclosure including examples shown in FIG. 2 through FIG. 10. In addition, the array substrate includes a plurality of first power signal input lines disposed in thin films on the substrate. In some embodiments, each of the plurality of first power signal lines is connected to the first power signal input port per pixel driving circuit.

In some embodiments, the plurality of first power signal lines are arranged in a mesh pattern. For example, some of the plurality of first power signal lines may be disposed in transversal direction while some others of the plurality of first power signal lines may be disposed in longitudinal direction. The mesh pattern arrangement allows the potential levels of the first power signals to be balanced in both the longitudinal and transversal directions, or at least no big difference between the potential level of the first power signal received at each first power signal input port associated with each of multiple pixel driving circuits arranged in transversal direction and the potential level of the first power signal received at each first power signal input port associated with each of multiple pixel driving circuits arranged in longitudinal direction. This enables a more stable operation of driving the pixels for emitting light during image display.

In some embodiments, the array substrate further includes a plurality of scan lines, a plurality of data lines, a plurality of initialization voltage lines, a plurality of initialization control signal lines, and a plurality of emission control lines respectively disposed in one or more thin films on the glass substrate. Each of the plurality of scan lines is connected to the second input port of the compensation control signal per pixel driving circuit. Each of the plurality of data lines is connected to the data input port per pixel driving circuit. Each of the plurality of initialization voltage lines is connected to the first input port of the initialization voltage signal per pixel driving circuit. Each of the plurality of initialization control signal lines is connected to the third input port of the initialization control signal per pixel driving circuit. Each of the plurality of emission control lines is connected to the fourth input port of the emission control signal per pixel driving circuit.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A pixel driving circuit configured to operate in a display cycle including sequentially an initialization period, a compensation period, and a light-emitting period, the pixel driving circuit comprising:

a driving transistor having a gate, a source, and a drain;

a first storage capacitor having a first terminal connected to the gate of the driving transistor and a second terminal connected to a first power signal input port;

an emission control sub-circuit disposed between the source of the driving transistor and the first power signal input port, the emission control sub-circuit comprising a first emission-control transistor, the first emission-control transistor having a first terminal connected to the first power signal input port, and a second terminal connected to the source of the driving transistor;

a data write-in sub-circuit disposed between a data input port and the drain of the driving transistor which is also connected to the emission control sub-circuit, the data write-in sub-circuit being connected to the driving transistor through the drain of the driving transistor;

a compensation sub-circuit disposed between the source of the driving transistor and the first terminal of the first storage capacitor, the compensation sub-circuit being connected to the driving transistor through the source of the driving transistor; and a light emitting device having a first terminal connected to the emission control sub-circuit and a second terminal connected to a second power signal input port;

wherein the data write-in sub-circuit is configured to control a data voltage signal to be passed into the drain of the driving transistor during the compensation period; the compensation sub-circuit is configured to control a connection between the source and the gate of the driving transistor during the compensation period to set the driving transistor to a conduction state for inducing a source-to-drain current until a gate voltage of the driving transistor reaches a value substantially equal to the data voltage signal plus a threshold voltage of the driving transistor.

2. The pixel driving circuit of claim 1, further comprising:

a first initialization sub-circuit connected to the light emitting device and configured to control a connection between the first terminal of the light emitting device and a first input port of an initialization voltage signal.

3. The pixel driving circuit of claim 2, further comprising:

a second initialization sub-circuit connected to the gate of the driving transistor and configured to control a connection between the gate of the driving transistor and the first input port of the initialization voltage signal.

4. The pixel driving circuit of claim 1, wherein the emission control sub-circuit is configured to control, during the light-emitting period, a first connection between the source of the driving transistor and the first power signal input port and a second connection between the drain of the driving transistor and the first terminal of the light emitting device.

5. The pixel driving circuit of claim 4, wherein the data write-in sub-circuit comprises a data-write-in transistor having a gate connected to a second input port of a compensation control signal, a first terminal connected to the drain of the driving transistor, and a second terminal connected to the data input port.

6. The pixel driving circuit of claim 5, wherein the compensation sub-circuit comprises a compensation transistor having a gate connected to the second input port of the compensation control signal, a first terminal connected to the source of the driving transistor, and a second terminal connected to the gate of the driving transistor.

7. The pixel driving circuit of claim 3, wherein the first initialization sub-circuit comprises a first initialization transistor having a gate connected to a third input port of an initialization control signal, a first terminal connected to the first input port of the initialization voltage signal, and a second terminal connected to the first terminal of the light emitting device; the second initialization sub-circuit comprises a second initialization transistor having a gate connected to the third input port of the initialization control signal, a first terminal connected to the gate of the driving transistor, and a second terminal connected to the first input port of the initialization voltage signal.

8. The pixel driving circuit of claim 3, wherein the emission control sub-circuit further comprises a second emission-control transistor; the first emission-control transistor having a gate connected to an fourth input port of an emission control signal; the second emission-control transistor having a gate connected to the fourth input port of the emission control signal, a first terminal connected to the drain of the driving transistor, and a second terminal connected to the first terminal of the light emitting device.

9. The pixel driving circuit of claim 7, further comprising a second storage capacitor having a first terminal connected to the gate of the driving transistor and a second terminal connected to the first input port of the initialization voltage signal.

10. The pixel driving circuit of claim 1, wherein the light emitting device comprises an organic light emitting diode with the first terminal being an anode and the second terminal being a cathode.

11. A method of driving a pixel driving circuit of claim 1, the method comprising:

controlling passage of the data voltage signal from the data input port to the drain of the driving transistor using the data write-in sub-circuit during the compensation period of a display cycle; and controlling a connection between the source of the driving transistor and the gate of the driving transistor using the compensation sub-circuit during the compensation period, to set the driving transistor to a conduction state for inducing a source-to-drain current until a gate voltage of the driving transistor reaches a value substantially equal to the data voltage signal plus a threshold voltage of the driving transistor.

12. The method of claim 11, wherein the pixel driving circuit comprises a first initialization sub-circuit connected to the first terminal of the light emitting device, the method comprising:

controlling the first terminal of the light emitting device to receive an initialization voltage from a first input port using the first initialization sub-circuit during the initialization period of the display cycle, the initialization period being prior to the compensation period.

13. The method of claim 12, wherein the pixel driving circuit comprises a second initialization sub-circuit connected to the gate of the driving transistor, the method comprising:

controlling the gate of the driving transistor to be initialized at the initialization voltage from the first input port using the second initialization sub-circuit during the initialization period.

14. The method of claim 11, comprising:

controlling a connection between the source of the driving transistor and the first power signal input port and a connection between the drain of the driving transistor and the first terminal of the light emitting device using the emission control sub-circuit during the light-emitting period, to set the driving transistor in a conduction state with a current for driving light emitting device to emit light, the light emitting period being next to the compensation period.

15. The method of claim 11, wherein the data write-in sub-circuit comprises a data-write-in transistor having a gate connected to a second input port of a compensation control signal, a first terminal connected to the drain of the driving transistor, and a second terminal connected to the data input port, the method further comprising:

setting the data-write-in transistor in a conduction state using the compensation control signal from the second input port, to connect the drain of the driving transistor to the data input port so as to control passing the data voltage signal from the data input port to the drain of the driving transistor.

16. The method of claim 15, wherein the compensation sub-circuit comprises a compensation transistor having a gate connected to the second input port of the compensation control signal, a first terminal connected to the source of the driving transistor, and a second terminal connected to the gate of the driving transistor, the method further comprising:

setting the compensation transistor to a conduction state using the compensation control signal, to connect the source of the driving transistor to the gate of the driving transistor.

17. The method of claim 12, wherein the first initialization sub-circuit comprises a first initialization transistor having a gate connected to a third input port of an initialization control signal, a first terminal connected to the first input port for an initialization voltage signal, and a second terminal connected to the first terminal of the light emitting device, the method further comprising:

setting the first initialization transistor to a conduction state using the initialization control signal, to connect the first input port to the first terminal of the light emitting device to pass the initialization voltage signal from the first input port to the first terminal of the light emitting device.

18. The method of claim 13, wherein the second initialization sub-circuit comprises a second initialization transistor having a gate connected to a third input port of an initialization control signal, a first terminal connected to the gate of the driving transistor, and a second terminal connected to the first input port of an initialization voltage signal, the method further comprising:

setting the second initialization transistor to a conduction state using the initialization control signal, to connect the first input port to the gate of the driving transistor to pass the initialization voltage signal from the first input port to the gate of the driving transistor.

19. An array substrate, comprising a plurality of pixel driving circuits of claim 1 on a substrate.

20. The array substrate of claim 19, further comprising a plurality of first power signal input lines disposed in a thin film on the substrate; and a plurality of scan lines, a plurality of data lines, a plurality of initialization voltage lines, a plurality of initialization control signal lines, and a plurality of emission control lines respectively disposed in one or more thin films on the substrate;

wherein each of the plurality of first power signal input lines is connected to the first power signal input port per pixel driving circuit; wherein the plurality of first power signal input lines is arranged in a mesh pattern spatially each of the plurality of scan lines is connected to a second input port of a compensation control signal per pixel driving circuit;

each of the plurality of data lines is connected to the data input port per pixel driving circuit;

each of the plurality of initialization voltage lines is connected to a first input port of an initialization voltage signal per pixel driving circuit;

each of the plurality of initialization control signal lines is connected to a third input port of an initialization control signal per pixel driving circuit; and each of the plurality of emission control lines is connected to a fourth input port of an emission control signal per pixel driving circuit.

* * * * *